US010119395B2

(12) United States Patent
Shanfield

(10) Patent No.: US 10,119,395 B2
(45) Date of Patent: Nov. 6, 2018

(54) METHOD FOR ENHANCING ACOUSTIC COMMUNICATIONS IN ENCLOSED SPACES USING DISPERSION COMPENSATION

(71) Applicant: The Charles Stark Draper Laboratory, Inc., Cambridge, MA (US)

(72) Inventor: Stanley R. Shanfield, Newton, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 439 days.

(21) Appl. No.: 15/055,718

(22) Filed: Feb. 29, 2016

(65) Prior Publication Data

US 2016/0258286 A1 Sep. 8, 2016

Related U.S. Application Data

(60) Provisional application No. 62/128,158, filed on Mar. 4, 2015.

(51) Int. Cl.
*E21B 47/16* (2006.01)
*E21B 47/18* (2012.01)

(52) U.S. Cl.
CPC ..... *E21B 47/18* (2013.01); *E21B 47/16* (2013.01)

(58) Field of Classification Search
CPC .. G01V 1/44; G01V 1/50; E21B 47/14; E21B 47/18; E21B 47/16; E21B 47/182
See application file for complete search history.

(56) References Cited

U.S. PATENT DOCUMENTS

| | | | |
|---|---|---|---|
| 6,088,294 | A | 7/2000 | Leggett, III et al. |
| 6,320,820 | B1 | 11/2001 | Gardner et al. |
| 6,817,412 | B2 | 11/2004 | Haase |
| 7,423,931 | B2 | 9/2008 | Martin, II et al. |
| 7,835,226 | B2 | 11/2010 | Kokosalakis et al. |
| 8,339,277 | B2 | 12/2012 | Spross et al. |
| 2005/0168349 | A1 | 8/2005 | Huang et al. |
| 2007/0209865 | A1 | 9/2007 | Kokosalakis et al. |
| 2013/0118249 | A1 | 5/2013 | Conn |
| 2015/0003202 | A1 | 1/2015 | Palmer et al. |

OTHER PUBLICATIONS

International Searching Authority, International Search Report—International Application No. PCT/US2016/020009, dated May 6, 2016, together with the Written Opinion of the International Searching Authority, 10 pages.

*Primary Examiner* — Hovhannes Baghdasaryan
(74) *Attorney, Agent, or Firm* — Sunstein Kann Murphy & Timbers LLP

(57) ABSTRACT

A method for extending the range of acoustic data communication within a fluid enclosed in a pipe, such as in a production petroleum well. The method includes providing an acoustic transmitter and receiver in the pipe separated by a distance d. The transmitter converts the ith data bit into a propagating waveform in the pipe. The propagating waveform is received by the receiver after traversing the distance d. The received propagating waveform for the given data bit is then compensated for dispersion using an adaptive process to find the best statistical fit between the dispersed signal and the known signal shape.

6 Claims, 5 Drawing Sheets

METHOD FOR ENHANCING ACOUSTIC COMMUNICATIONS IN ENCLOSED SPACES USING DISPERSION COMPENSATION

CROSS REFERENCE TO RELATED APPLICATIONS

The present application claims the benefit of U.S. Provisional Patent Application No. 62/128,158 filed Mar. 4, 2015, the disclosure of which is incorporated by reference herein in its entirety.

TECHNICAL FIELD

The present invention relates to the use of acoustic telemetry within enclosed spaces and, more particularly, to enhancing acoustic communication using dispersion compensation.

BACKGROUND ART

In the petroleum industry, acoustic telemetry (reporting down-hole sensor readings) during the drilling process has been analyzed in detail in the open literature. However, acoustic telemetry within producing wells has not received much attention. In contrast to the relatively straightforward acoustic conditions during drilling, dispersion is a significant issue for down hole communication in a producing well. The ability to extend the range of an acoustic telemetry system in a producing well has economic value and, with better monitoring in producing wells, it may indirectly help prevent water table contamination as well as other environmental problems.

SUMMARY OF THE EMBODIMENTS

A method for extending the range of acoustic data communication within a fluid enclosed in a pipe is provided. The method includes providing an acoustic transmitter and receiver in the pipe separated by a distance d. The transmitter converts the $i^{th}$ data bit into a propagating waveform in the pipe. The propagating waveform is received by the receiver after traversing the distance d. The received propagating waveform for the given data bit is then compensated for dispersion including computing the injected waveform for a selected propagation time T according to:

$$f_i(t)=\Im^{-1}(e^{-i\omega(t+T)}\Im(p_i(t)))$$

where $p_i(t)$ is the measured sound pressure for the $i^{th}$ bit convolving the computed injected waveform for the selected propagation time T with the received propagating waveform according to:

$$C_i=(\int_{\tau_1}^{\tau_2}[\int_{\theta_1}^{\theta_1\Delta t}f_i(t)*f_t(\tau-t)dt]^2d\tau)^{1/2}$$

where $f_t$ is the known waveform at the transmitter;

then, comparing $C_i$ to previous values of $C_i$ if any for the data bit and determining if $C_i$ is maximized by the selected propagation time T using a statistical optimization algorithm;

when $C_i$ is not maximized, adjusting the selected propagation time T using the statistical optimization algorithm and repeating the prior steps; and when $C_i$ is maximized, using $C_i$ to determine the value of the given bit.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

In various embodiments of the invention, a method is provided for extending the range of acoustic data communication in a fluid enclosed in a cylindrical pipe, such as in a production petroleum well. Embodiments of the invention effectively reverse the dispersion-induced spread of a transient signal and make practical longer transmission distances for a given bit rate. Because along with dispersion, noise is always present in a real system, an adaptive process is used to find the best statistical fit between the dispersed signal and the known signal shape.

Figure 1:
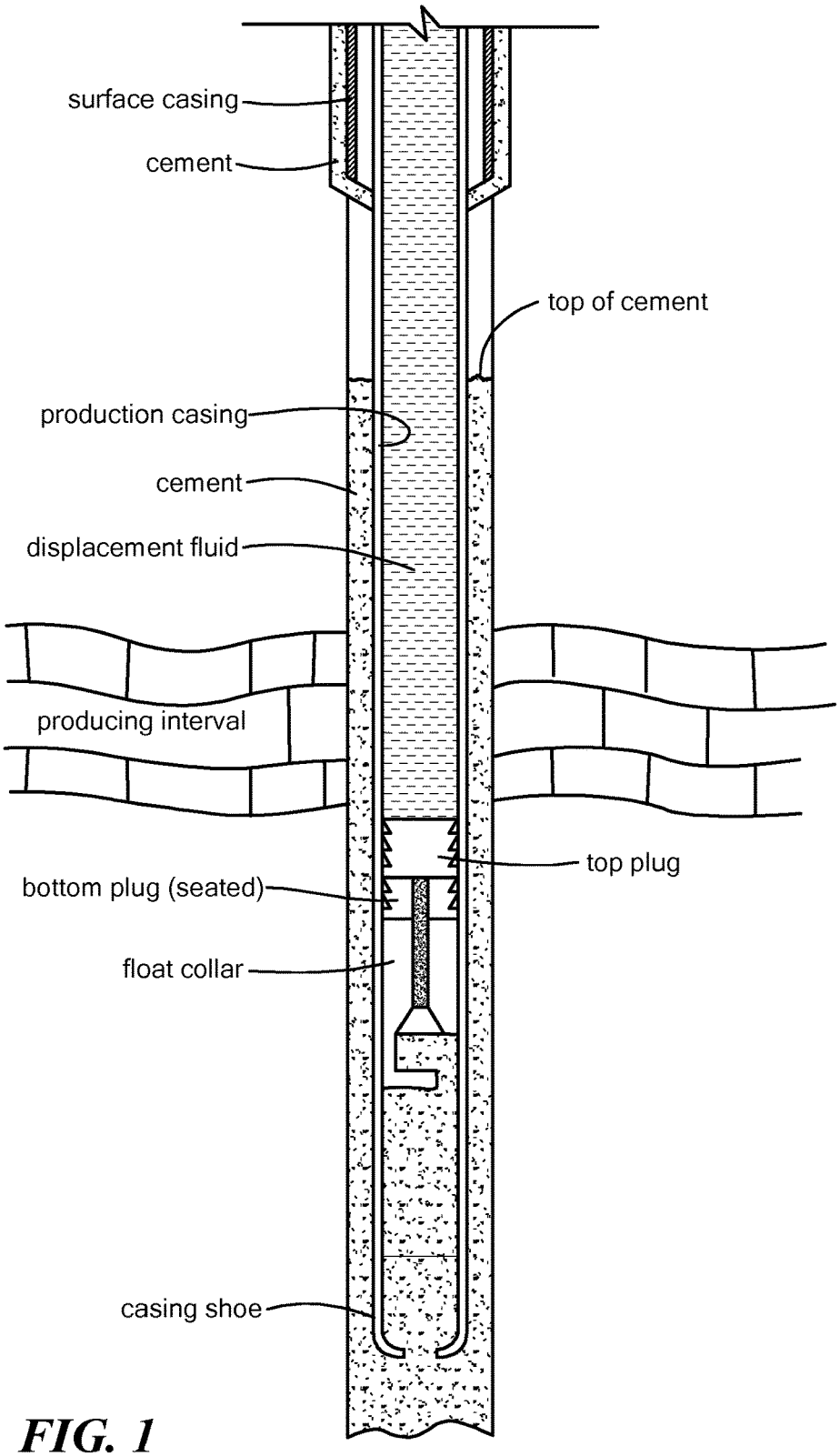
FIG. 1 is a cylindrical cross section of an exemplary petroleum well showing the position of casing, cement and fluid.
Figure 2:
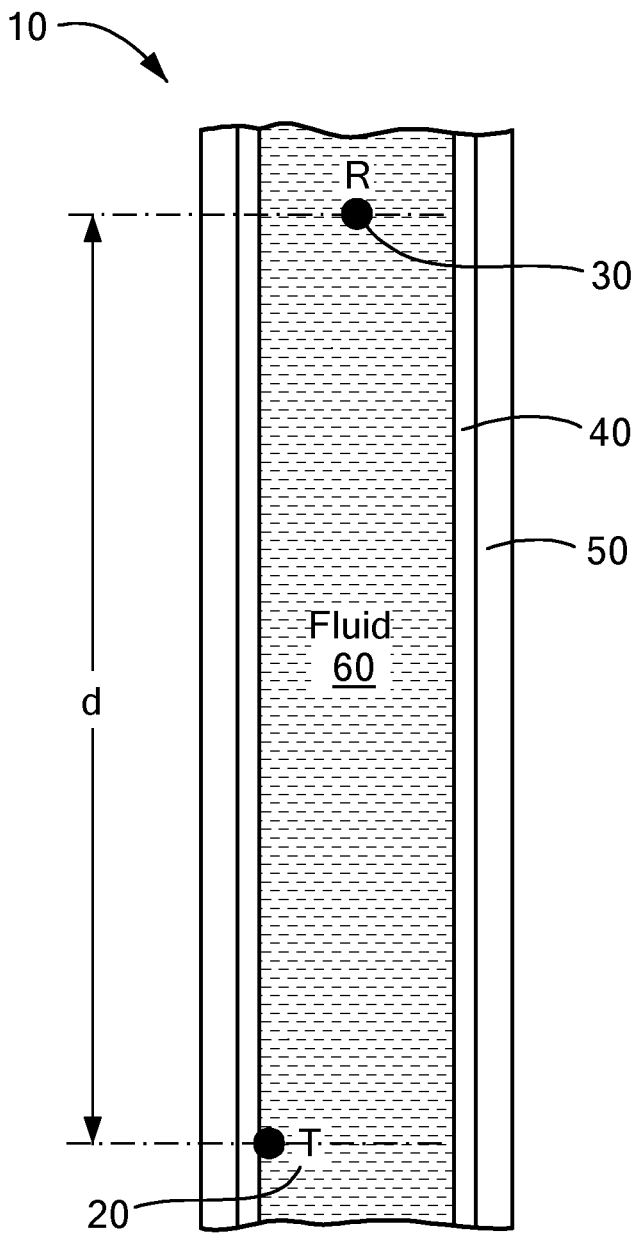
FIG. 2 is a diagram showing schematically the well of FIG. 1 with the addition of acoustic transmitter and receiver according to an embodiment of the invention.

FIG. 1 shows the cylindrical cross section of an exemplary petroleum well indicating the positions of casing, cement and fluid. FIG. 2 shows a simplified cross-sectional view of the petroleum well of FIG. 1 10 during the production phase in a preferred embodiment of the invention. An acoustic transmitter 20 and an acoustic receiver 30 separated by an axial distance "d" have been added to the piping 40 (with cement liner 50). The position of the acoustic transmitter is shown in FIG. 1 at the inside surface of the metal cylinder, but in various embodiments of the invention the acoustic energy can be delivered to that location from a transducer located outside the pipe. The transmitter launches acoustic waves into the fluid with a particular waveform, and these pressure waves eventually reach the receiver 30. For this embodiment, by way of example but not for limitation, the fluid 60 can be considered incompressible, e.g., water. The modes that propagate in the confined fluid can be determined such that pressure p at a location in cylindrical coordinates r, Φ, z is given by the Helmholtz equation:

$$p(r,\emptyset,z)=\sum_{m=1}^{M}[J_m(\gamma r_o)\Phi_m(\phi_o)]J_m(\gamma r)\Phi_m(\phi)e^{i\kappa_m(z-z_o)} \quad (1)$$

In equation 1, k is equal to $(2\pi f)/c_f$ where $c_f$ is the speed of sound in the fluid and radial and longitudinal wavenumbers obey the dispersion relationship:

$$k^2=\gamma_{m,n}^2+\kappa_{m,n}^2 \text{ for } \kappa_{m,n};$$

a real number, where n is defined by the boundary conditions, as shown below. The coordinates of the sound source are $r_0$, $\phi_0$, and $z_0$ and the function Φm is either sin(ϕ) or cos(ϕ) as a result of the boundary conditions. For ease of explanation, a "no-radial-motion" boundary condition can be specified at the cylinder radius, $r_c$:

$$\frac{\partial}{\partial r} J_n(\gamma r)\Big|_{r=r_c} = 0 \tag{2}$$

The boundary condition in Eqn 2 is applicable when the source frequency is much higher than the pipe ringing frequency, i.e., the source is ultrasonic. Note, however, that this boundary condition is not required in general for all embodiments of the invention. Combining the solutions of Eqn. 2 into Eqn. 1, a large number of allowable acoustic modes can be derived, i.e., for each "m" in equation 1 there are a finite number of propagating solutions, n=1, 2, . . . $n_{max}$ in equation 2 that define $\gamma_{m,n}$. An important point about these mode solutions is that they propagate at a different group velocity for each value of m in Eqn. 1 and n in Eqn 2. From the dispersion relationship, the $(m,n)^{th}$ group velocity is:

$$u_{m,n} = \left(\frac{k_{m,n}}{k}\right) c_f \tag{3}$$

Figure 3:
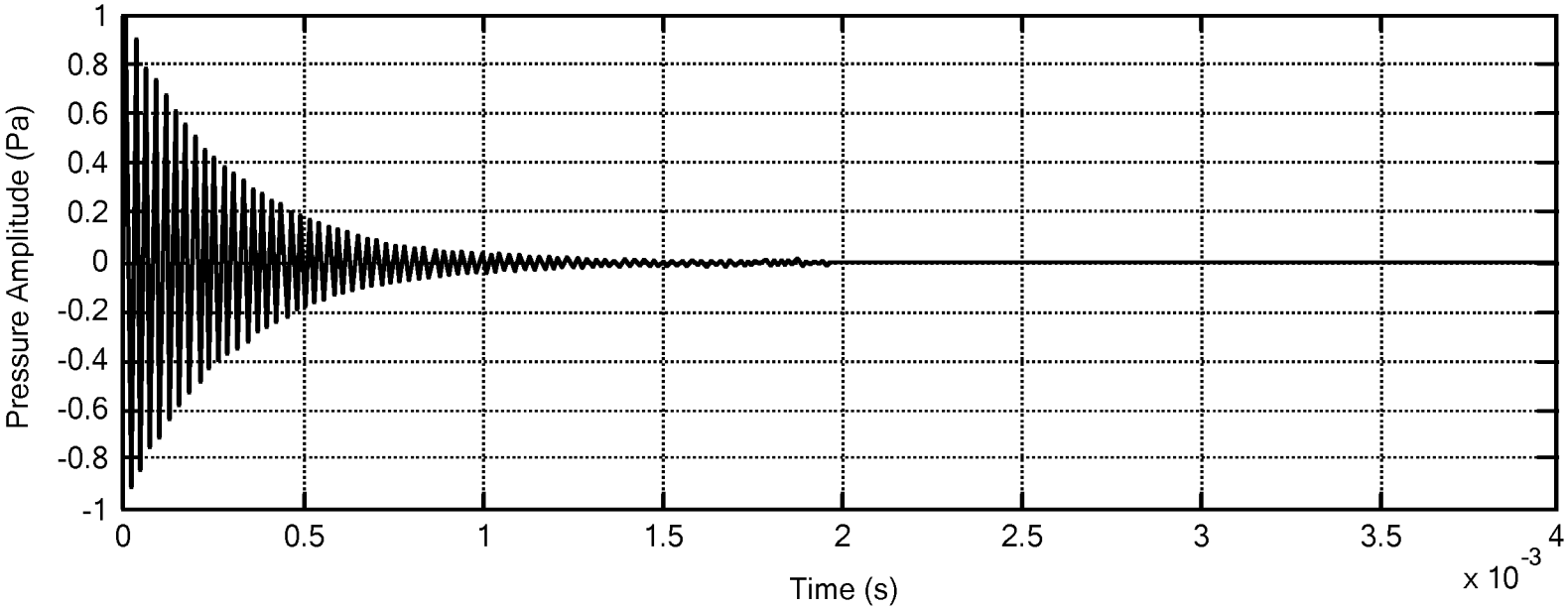
FIG. 3 shows a modelled pressure waveform at the transmitter of the embodiment of FIG. 2.
Figure 4:
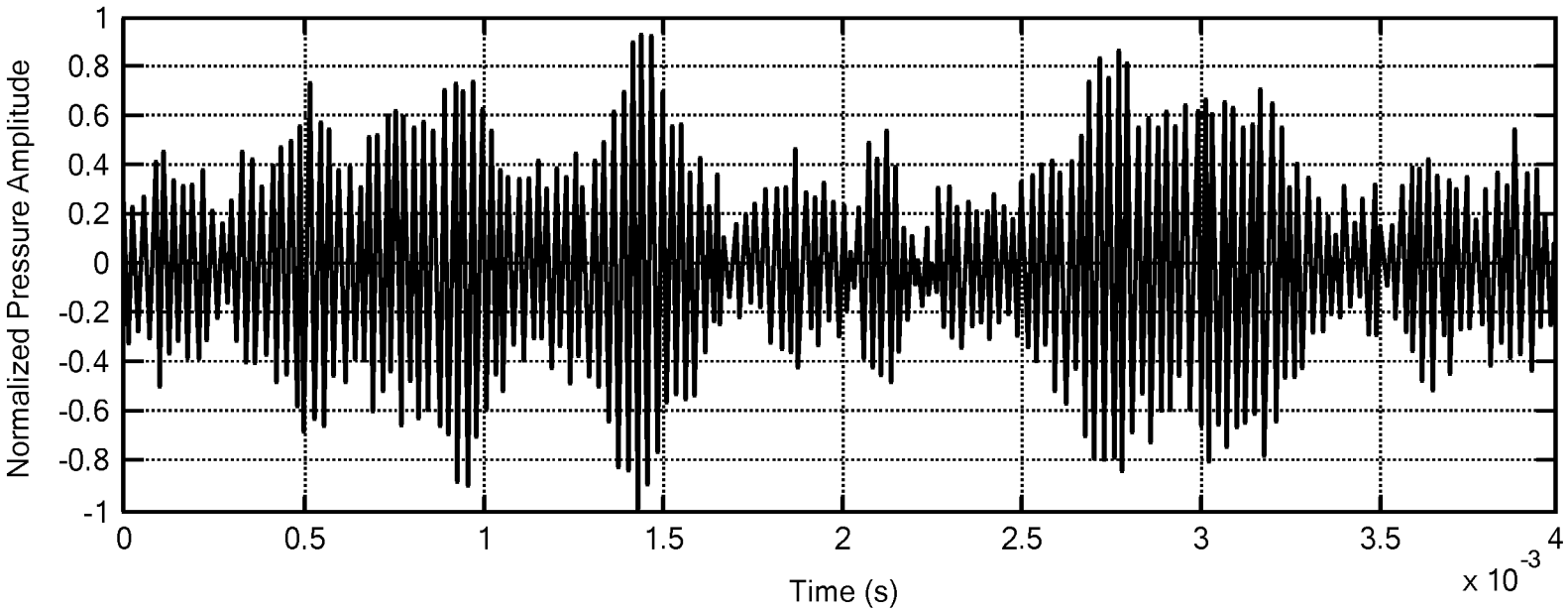
FIG. 4 shows a calculated waveform at a point a thousand meters from the transmitter for the transmitted waveform of FIG. 3.

If acoustic communication through the cylinder fluid in the well piping 40 is to be effected with encoded sound, a modulation scheme analogous to that used with electromagnetic transmitters and receivers can be implemented. However, conventional modulation schemes are predicated on the understanding that transients in amplitude, frequency, or phase generated at the transmitter propagate coherently through the fluid over long distances, i.e., the transient waveform shape is at least approximately retained over the communication distance. Unfortunately, evaluation of Equation 3 for conditions that might be found in a petroleum production well show that transient waveforms rapidly change shape and "spread out" as they propagate, even over short axial distances. FIG. 3 shows an example acoustic waveform launched at one end of a 1000 meter cylinder with diameter 40 cm and filled with water. Using solutions described by Equations 1 and 2, FIG. 4 shows the calculated pressure at a point in the center of the cylinder 1000 meters from the transmitter. A comparison of the transmitted waveform and the received waveform makes it apparent that the waveform is unrecognizable at the receiver. This distortion occurs because the different frequency components of the transmitted pulse have propagated at different group velocities. If a single bit is represented by the impulse shown in FIG. 3, it is not obvious from the received waveform that this bit has been transmitted.

In embodiments of the invention, a method to counteract distortion created by dispersion is provided. For simplicity, this disclosure describes dispersion compensation at the receiver, but it should be understood that, in other embodiments, a similar procedure can be applied at the transmitter to "shape" or pre-condition the initial signal to counteract the dispersion caused by the communication channel. Unlike multipath electromagnetic radiation in a complex physical environment, the dispersion of sound is considerably more predictable because the physical shape of the structure, i.e., a cylinder, containing the fluid is known. Consequently, the distortion created by the dispersion can be at least partially mathematically "removed" using an iterative process. Therefore, whatever modulation waveform was used at the transmitter will be at least approximately available at the receiver. For example, if OFDM modulation is used with quadrature at each sub-frequency band, each sub-frequency band can transmit a greater distance. Alternatively, the method can be used to allow a higher bit rate, since it allows more time overlap between each bit modulation.

Suppose that the measured pressure as a function of time at a receiver for a given bit #1 at a known axial distance d from a transmitter is given by $p_1(t)$. The measured function $p_1(t)$ contains noise with an arbitrary distribution and the propagated signal. The original transmitter waveform combined with transformed noise, labeled $f_1(t)$, can be extracted as follows:

$$f_1(t) = \mathfrak{F}^{-1}(e^{-\omega(t+T)}\mathfrak{F}(p_1)(t))) \tag{4}$$

In Equation 4, the symbols $\mathfrak{F}$ and $\mathfrak{F}^{-1}$ indicate Fourier Transform and Inverse Fourier Transform, respectively, and the nominal value of T is $T=d/c_f$. Equation 4, which can be put into discrete (digital) measurement form, "recreates" the waveform of the original transmitted signal, but it is apparent that the choice of T can be adjusted to obtain a best fit, since the shape of the original waveform is usually known. An adaptive algorithm operating at the receiver, then, can take the waveform corresponding to a single bit and adjust the value of T to maximize the following convolution and summation:

$$C_1 = \left(\int_{\tau_1}^{\tau_2}\left[\int_{\Theta_1}^{\Theta_1+\Delta t} f_1(t) * f_i(\tau - t)\,dt\right]^2 d\tau\right)^{1/2} \tag{5}$$

The function $f_1$ is the known waveform at the transmitter (a decaying sinusoid, for example), and the function $f_1(t)$ is given in Equation 4. The range $\tau_1$ to $\tau_2$ is the range over which the integrand function of $\tau$ contributes significantly to the integral in $d\tau$ (the integrand function would have the form of $\text{sinc}^2(a\tau)$ for the decaying sinusoid example), while $\Delta t$ is approximately the duration of the transient waveform representing the bit ($\Delta t$ is proportional to the decay time in the decaying sinusoid example). The value of $\Theta_1$ is the starting time for the bit, in this case, bit #1.

Figure 5:
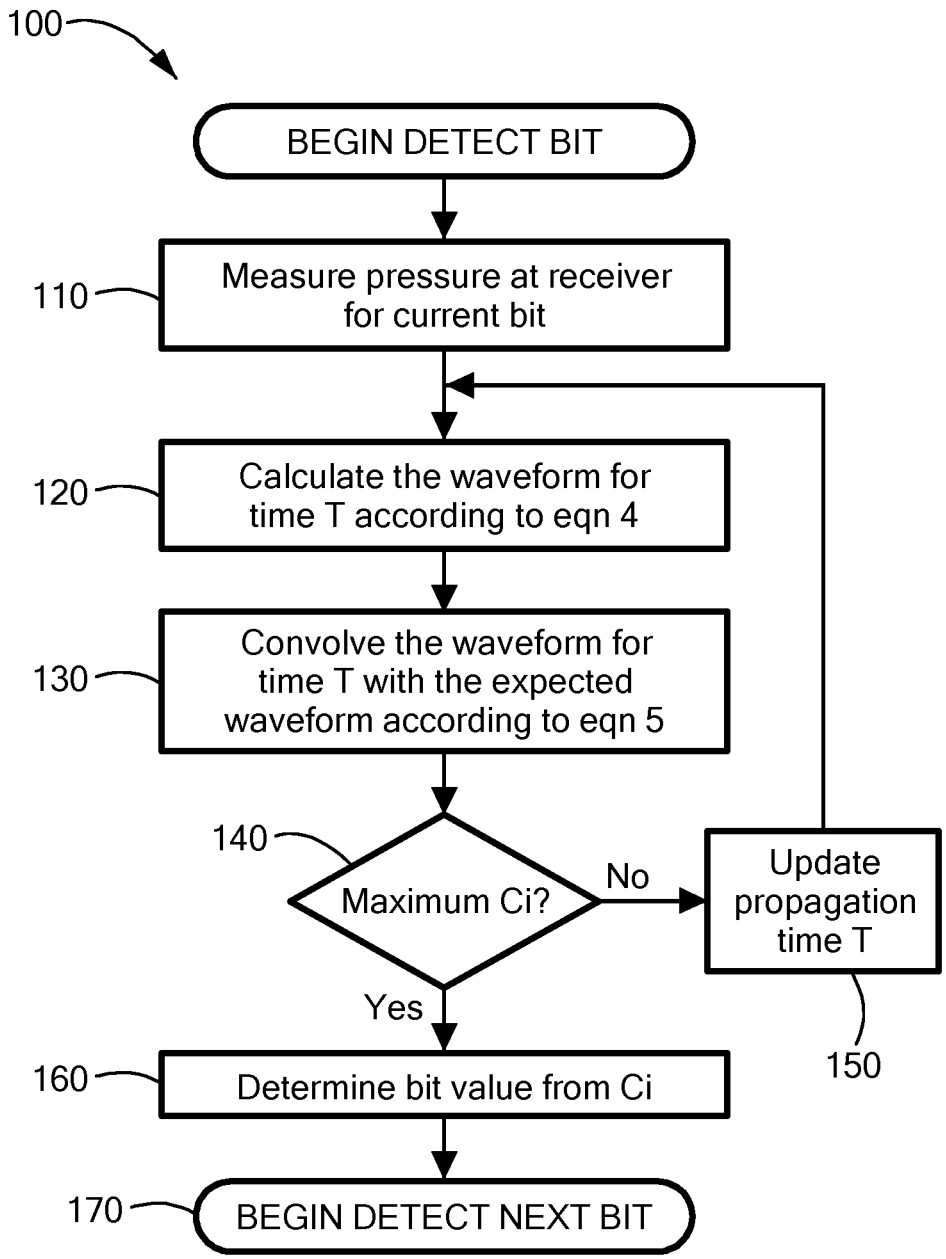
FIG. 5 shows a flow diagram for a method for extending the range of acoustic data communication within a fluid enclosed in a pipe by compensating for dispersion, according to an embodiment of the invention.

FIG. 5 shows a maximum root-means-squared algorithm ("MIMS") for $C_i$ that creates an adaptive loop 100 for determining the value of the current bit according to an embodiment of the invention. First, the pressure $p_i(t)$ is measured at the receiver for the current bit 110. The original transmitter waveform combined with transformed noise from the measured pressure at the receiver is computed with a selected propagation time, T, according to Equation 4 120. The computed waveform for the propagation time T is convolved with the known waveform at the transmitter to generate a parameter $C_i$ according to Equation 5 130. This calculated value for $C_i$ is compared to previous calculations for $C_{i-1}$, $C_{i-2}$, etc. Multiple comparisons with earlier calculations are required because the convolution includes some noise in the measured pressure, $p_i$. A statistical optimization algorithm, such as the method of steepest ascents, determines if the value of the selected T results in a maximum value for $C_i$ 140. If the maximum value for has not been found, the value for T is adjusted 150 and both the waveform and convolution are recalculated 120, 130. If the maximum value of $C_i$ is found, the value of C is used to make a decision on the value of the data bit 160. The optimization then moves to the next bit time interval 170 and steps 110, 120, etc. are repeated. The method of this embodiment requires that some portion of the dispersed waveform must be evaluated in Equation 4 120. As shown in the example of FIGS. 3 and 4, the dispersed waveform can be significantly longer than the duration of the original waveform. As a practical consequence, then, the bit transmission time may be much longer than the duration of the original signal corresponding to that bit. The greater the dispersion (i.e., the longer the distance between transmitter and receiver, or the more dispersive the enclosure), the longer it will take for the receiver to collect the dispersed signal and make a detection.

The embodiments of the invention described above are intended to be merely exemplary; numerous variations and modifications will be apparent to those skilled in the art. All such variations and modifications are intended to be within the scope of the present invention. Embodiments of the invention may be described, without limitation, by the claims that follow.

What is claimed is:

1. A method for extending the range of acoustic data communication within a fluid enclosed in a pipe, comprising:

a. providing the pipe enclosing the fluid, a transmitter and a receiver, the transmitter and the receiver separated by a given distance;

b. modulating a given data bit for transmission;

c. converting the given data bit to an injected, acoustic waveform;

d. propagating the injected waveform via the enclosed fluid;

e. receiving the propagating waveform after traversing the given distance;

f. compensating the received propagating waveform for the given data bit for dispersion including:

i. computing the injected waveform for a selected propagation time T according to:

$$\Im^{-1}(e^{-i\omega(t+T)}\Im(p_i(t)))$$

ii. convolving the computed injected waveform for the selected propagation time T with the received propagating waveform according to:

$$C_i=(\int_{\tau_1}^{\tau_2}[\int_{\theta_1}^{\theta_1\Delta t}f_1(t)*f_i(\tau-t)dt]^2d\tau)^{1/2}$$

iii. comparing $C_i$ to previous values of $C_i$ if any for the data bit and determining if $C_i$ is maximized by the selected propagation time T using a statistical optimization algorithm;

iv. when $C_i$ is not maximized, adjusting the selected propagation time T using the statistical optimization algorithm and repeating steps i-iii; and v. when $C_i$ is maximized, using $C_i$ to determine the value of the data bit; and g. repeating steps a through f for a next data bit.

2. The method according to claim 1, wherein the fluid is a liquid.

3. The method according to claim 1, wherein the fluid is water.

4. The method according to claim 1, wherein the fluid is oil.

5. The method according to claim 1, wherein the fluid is a mixture including oil and water.

6. The method according to claim 1, wherein the statistical optimization algorithm is the method of steepest ascents.

* * * * *